US011660517B2

(12) United States Patent
Bear

(10) Patent No.: US 11,660,517 B2
(45) Date of Patent: May 30, 2023

(54) HOCKEY FACEOFF TRAINING DEVICE WITH DUAL-PURPOSE SUPPORT POSTS, RETRACTABLE GRIP SPIKES, INLINE SPRING JOINT AND GRIPPING CAVITIES

(71) Applicant: Conrad Bear, Winnipeg (CA)

(72) Inventor: Conrad Bear, Winnipeg (CA)

( * ) Notice: Subject to any disclaimer, the term of this patent is extended or adjusted under 35 U.S.C. 154(b) by 0 days.

(21) Appl. No.: 17/411,512

(22) Filed: Aug. 25, 2021

(65) Prior Publication Data

US 2022/0111279 A1 Apr. 14, 2022

(30) Foreign Application Priority Data

Sep. 21, 2020 (CA) ..... CA 3093689

(51) Int. Cl.
*A63B 69/00* (2006.01)
*A63B 71/02* (2006.01)

(52) U.S. Cl.
CPC ..... *A63B 69/0026* (2013.01); *A63B 71/023* (2013.01); *A63B 2071/024* (2013.01); *A63B 2071/026* (2013.01)

(58) Field of Classification Search
CPC ..... A63B 69/0026; A63B 71/023; A63B 2071/024; A63B 2071/026
USPC ..... 473/422, 446
See application file for complete search history.

(56) References Cited

U.S. PATENT DOCUMENTS 4,175,744 A * 11/1979 Llewellyn ..... A63B 21/0552 473/149
8,357,061 B2 * 1/2013 Quinn ..... A63B 59/70 473/422
10,729,959 B2 * 8/2020 Linneman ..... A63B 69/0026 473/446
2008/0078397 A1 * 4/2008 Scott ..... A61M 16/08 128/205.25
2017/0095717 A1 * 4/2017 Simonov ..... G09B 19/0038 473/446
2020/0353338 A1 * 11/2020 Cranston ..... A63B 59/70 473/446

(Continued)

FOREIGN PATENT DOCUMENTS

CA 2187393 A * 4/1998 ..... A63B 69/0024
CA 3093689 A1 * 11/2020 ..... A63B 60/0081
CN 209548654 U * 10/2019 ..... A63B 69/0026

*Primary Examiner* — Mitra Aryanpour
(74) *Attorney, Agent, or Firm* — Kyle R Satterthwaite; Ryan W Dupuis; Ade & Company Inc.

(57) ABSTRACT

A hockey faceoff training device has a base for placement on a playing surface, support posts standing upright from the base for placement of disc weights thereover into stacked condition atop the base for weighted anchoring thereof on the playing surface, a connector removably attached to top ends of the posts, and an impact member coupled to said connector via a moveable joint from which the impact members extends downwardly toward the playing surface in a default position. The movable joint comprises a coil spring situated inline with a proximal end of the impact member to bias the impact member into the default position. The base has deployable and retractable spikes to better grip the playing surface. The topside of the base comprises recessed access cavities to accommodate a user's fingers during placement or removal of the disc weights onto or from the base.

19 Claims, 6 Drawing Sheets

(56) References Cited

U.S. PATENT DOCUMENTS

| | | | | |
|---|---|---|---|---|
| 2020/0384325 | A1* | 12/2020 | Plizga | A63B 69/0026 473/446 |
| 2021/0379460 | A1* | 12/2021 | Megan | A63B 69/0026 473/446 |
| 2021/0394035 | A1* | 12/2021 | Cranston | A63B 71/03 473/446 |
| 2022/0111279 | A1* | 4/2022 | Bear | A63B 71/023 473/446 |

* cited by examiner

HOCKEY FACEOFF TRAINING DEVICE WITH DUAL-PURPOSE SUPPORT POSTS, RETRACTABLE GRIP SPIKES, INLINE SPRING JOINT AND GRIPPING CAVITIES

FIELD OF THE INVENTION

The present invention relates generally to training devices for athletes, and more particularly to a face-off training device for hockey players.

BACKGROUND

Applicant's prior U.S. Pat. No. 10,272,311 and corresponding Canadian Patent No. 2,953,597 both disclose a hockey faceoff training device, the illustrated embodiments of which were based on early prototypes of the device to which numerous improvements and modifications have since been made, preferred embodiments of which are disclosed herein below.

SUMMARY OF THE INVENTION

According to a first aspect of the invention, there is provided a hockey faceoff training device comprising:

a base for placement in a seated position atop an underlying playing surface, said base having an underside that faces said playing surface in said seated position and an opposing topside that faces upwardly away from said playing surface in said seated position;

one or more support posts attached or attachable to said base in a position standing upright therefrom over which disc weights are lowerable into stacked condition atop the base to weigh down said base in the seated position atop the underlying playing surface;

a connector removably attached or attachable to said one or more support posts at top ends thereof; and an impact member coupled to said connector via a moveable joint, said impact member having a proximal end adjacent said connector and an opposing distal end opposite said connector;

wherein said impact member is biased into a default position extending downwardly from the connector and placing the distal end of the impact member in contact or adjacency to the playing surface, and the impact member, by way of the movable joint, is movable in one or more directions lifting said distal end of the impact member upwardly away from said playing surface.

According to a second aspect of the invention, there is provided a hockey faceoff training device comprising:

a support structure positioned or positionable in a position standing upright from a playing surface;

an impact member having a proximal end supported, or arranged for support, on the support structure by a moveable joint at an elevated distance above said playing surface;

wherein:

said impact member is biased into a default position extending downwardly from the connector and placing the distal end of the impact member in contact or adjacency to the playing surface;

the impact member, by way of the movable joint, is movable in one or more directions lifting said distal end of the impact member upwardly away from said playing surface; and said movable joint comprises a coil spring and/or resiliently flexible rod that, in the default position of the impact member, resides in an unflexed default linear spanning along a linear axis in an in-line relationship with the proximal end of the impact member.

According to a third aspect of the invention, there is provided a hockey faceoff training device comprising:

a base for placement in a seated position atop an underlying playing surface, said base having an underside that faces said playing surface in said seated position and an opposing topside that faces upwardly away from said playing surface in said seated position;

an impact member having a proximal end supported, or arranged for support, by a moveable joint at an elevated distance above said base and an opposing distal end opposite said proximal end;

wherein:

said impact member is biased into a default position extending downwardly from the connector and placing the distal end of the impact member in contact or adjacency to the playing surface;

the impact member, by way of the movable joint, is movable in one or more directions lifting said distal end of the impact member upwardly away from said playing surface; and the base comprises deployable and retractable grip spikes movable between deployed positions of downwardly protruding relation to the underside of the base, and retracted positions of non-protruding relation to the underside of the base.

According to a fourth aspect of the invention, there is provided a hockey faceoff training device comprising:

a base for placement in a seated position atop an underlying playing surface, said base having an underside that faces said playing surface in said seated position and an opposing topside that faces upwardly away from said playing surface in said seated position;

one or more support posts attached or attachable to said base in a position standing upright therefrom over which disc weights are lowerable into stacked condition atop the base to weigh down said base in the seated position atop the underlying playing surface;

an impact member having a proximal end supported, or arranged for support, by a moveable joint at an elevated distance above said base and an opposing distal end opposite said proximal end;

wherein:

said impact member is biased into a default position extending downwardly from the connector and placing the distal end of the impact member in contact or adjacency to the playing surface;

the impact member, by way of the movable joint, is movable in one or more directions lifting said distal end of the impact member upwardly away from said playing surface; and the topside of the base, at one or more locations situated around each support post, comprises one or more recessed access cavities to accommodate a user's fingers during placement or removal of said disc weights onto or from said base.

BRIEF DESCRIPTION OF THE DRAWINGS

One embodiment of the invention will now be described in conjunction with the accompanying drawings in which.

DETAILED DESCRIPTION

Figure 1:
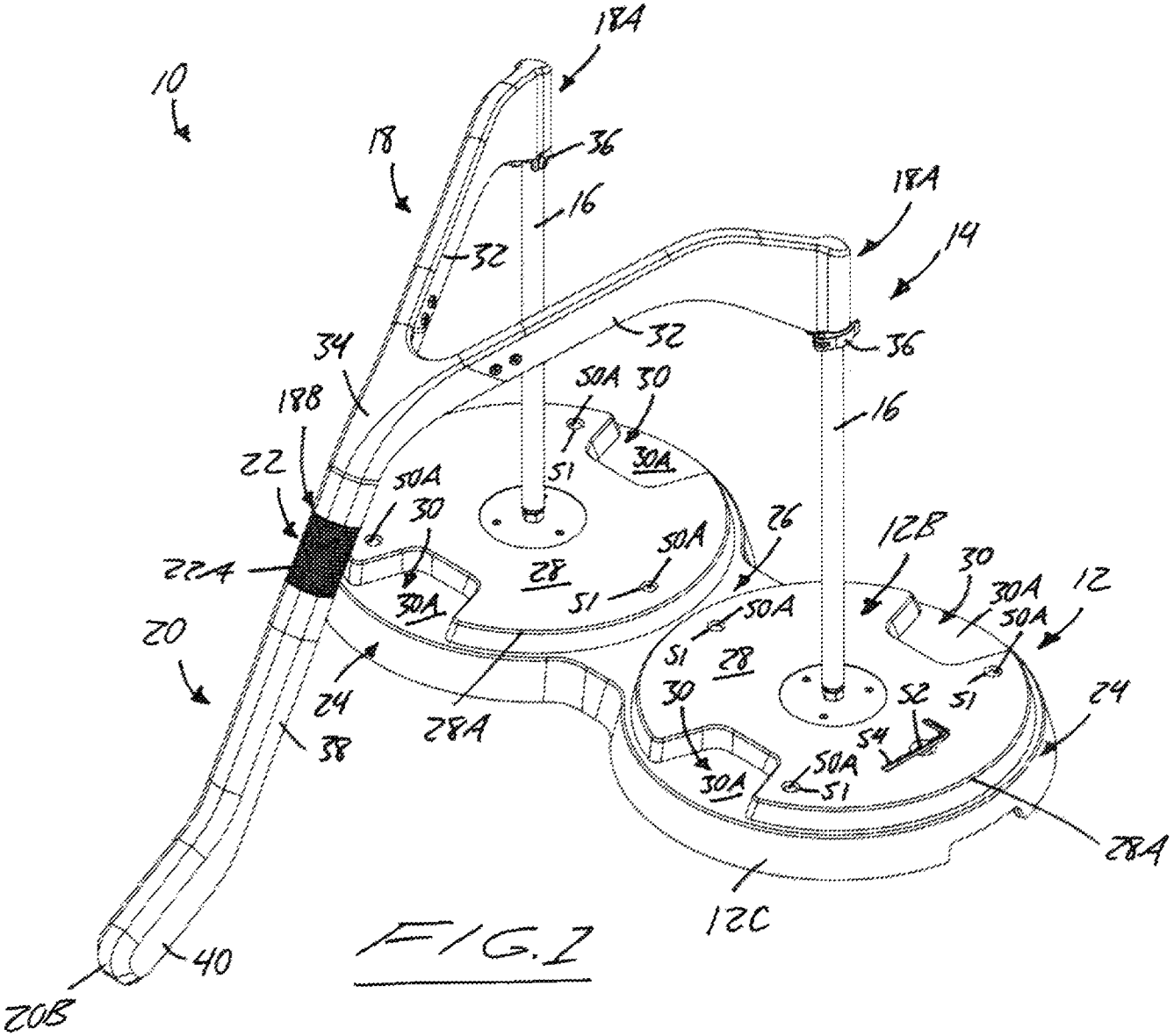
FIG. 1 is a perspective view of a hockey faceoff training device of the present invention.
Figure 2:
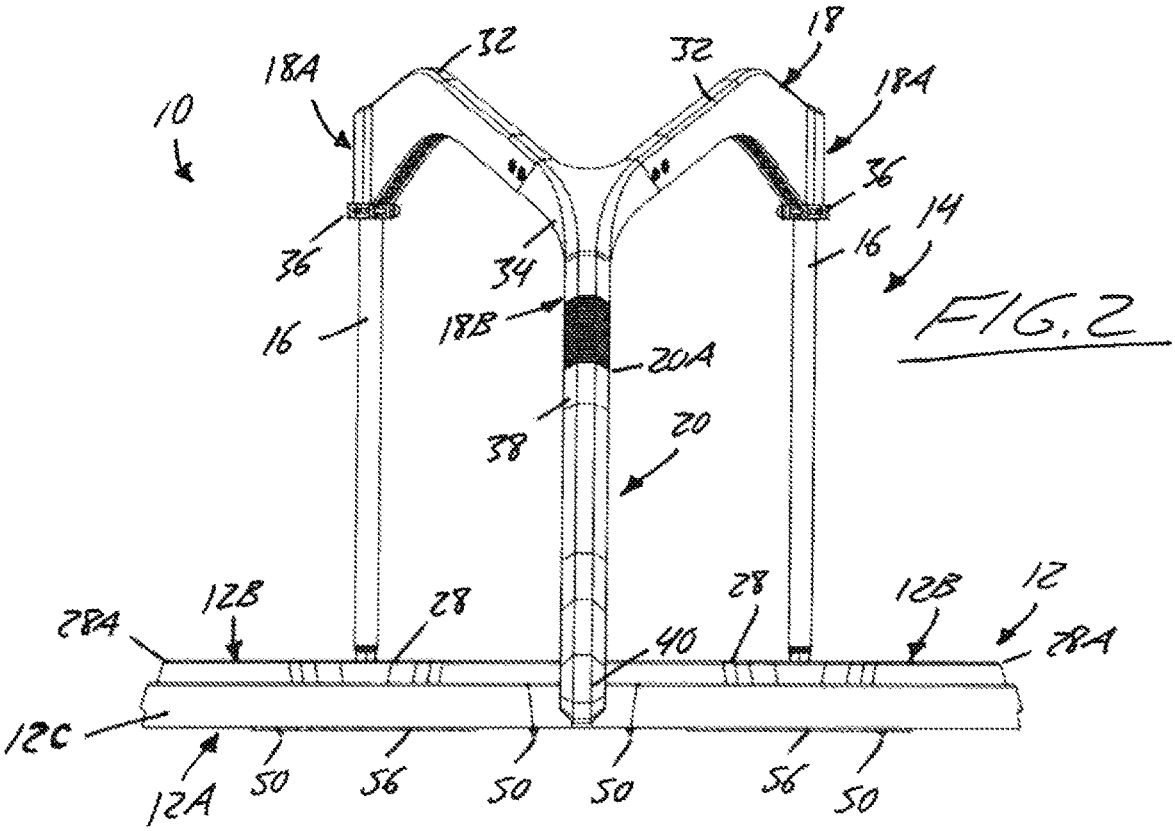
FIG. 2 is a front elevational view of the hockey faceoff training device.
Figure 3:
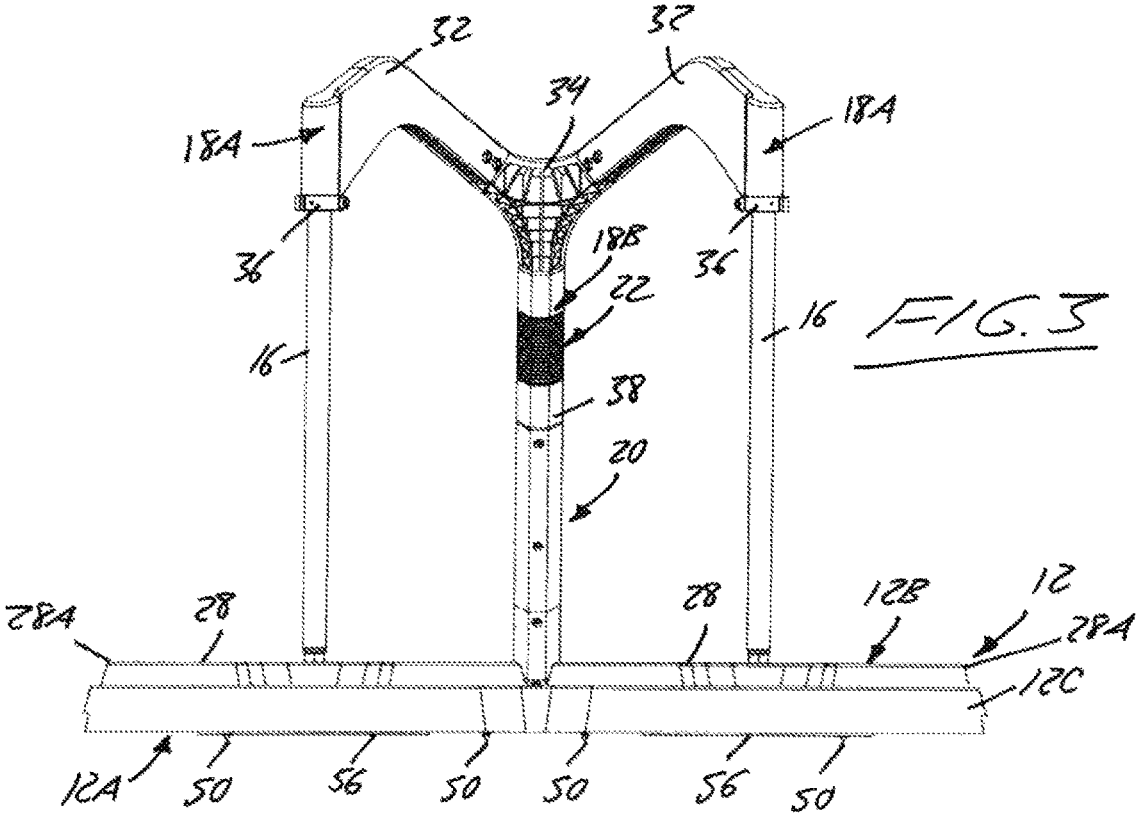
FIG. 3 is a rear elevational view of the hockey faceoff training device.
Figure 5:
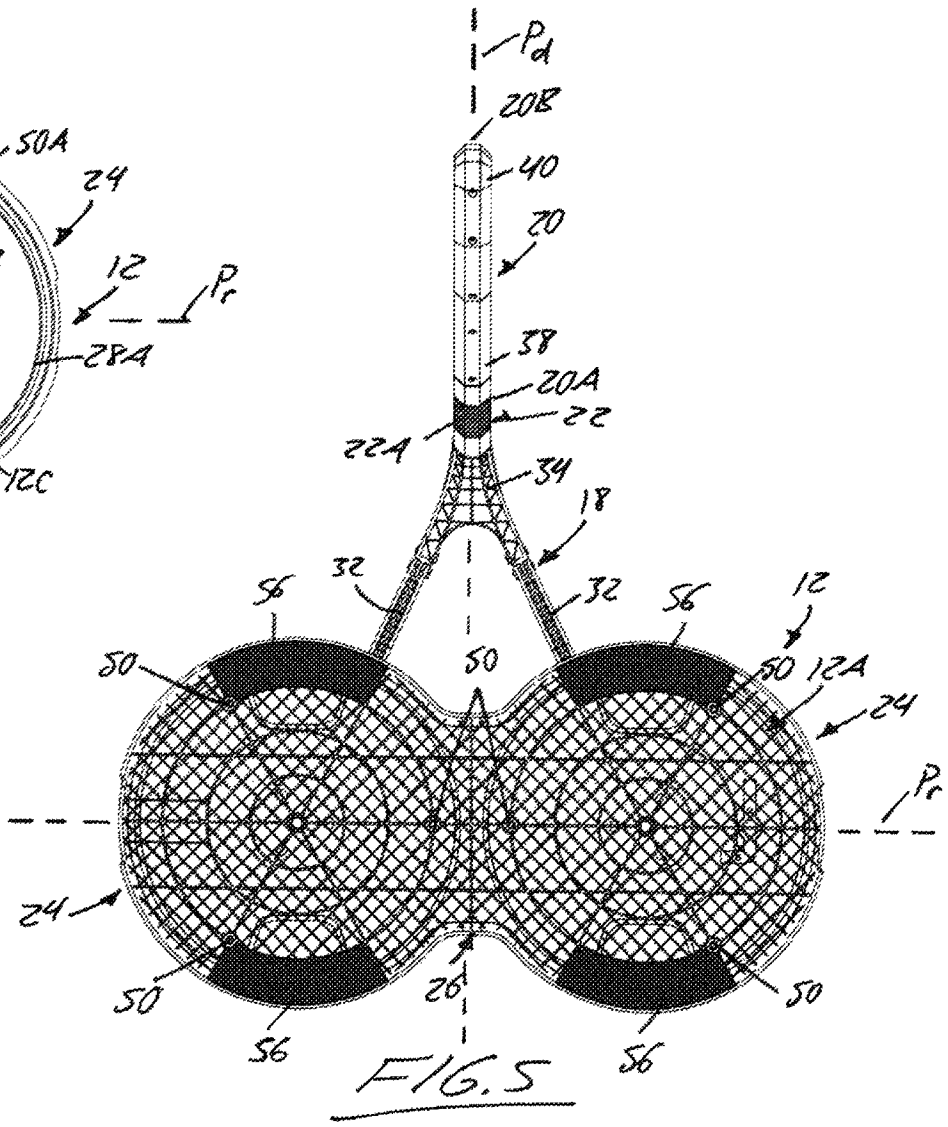
FIG. 5 is a bottom plan view of the hockey faceoff training device.
Figure 4:
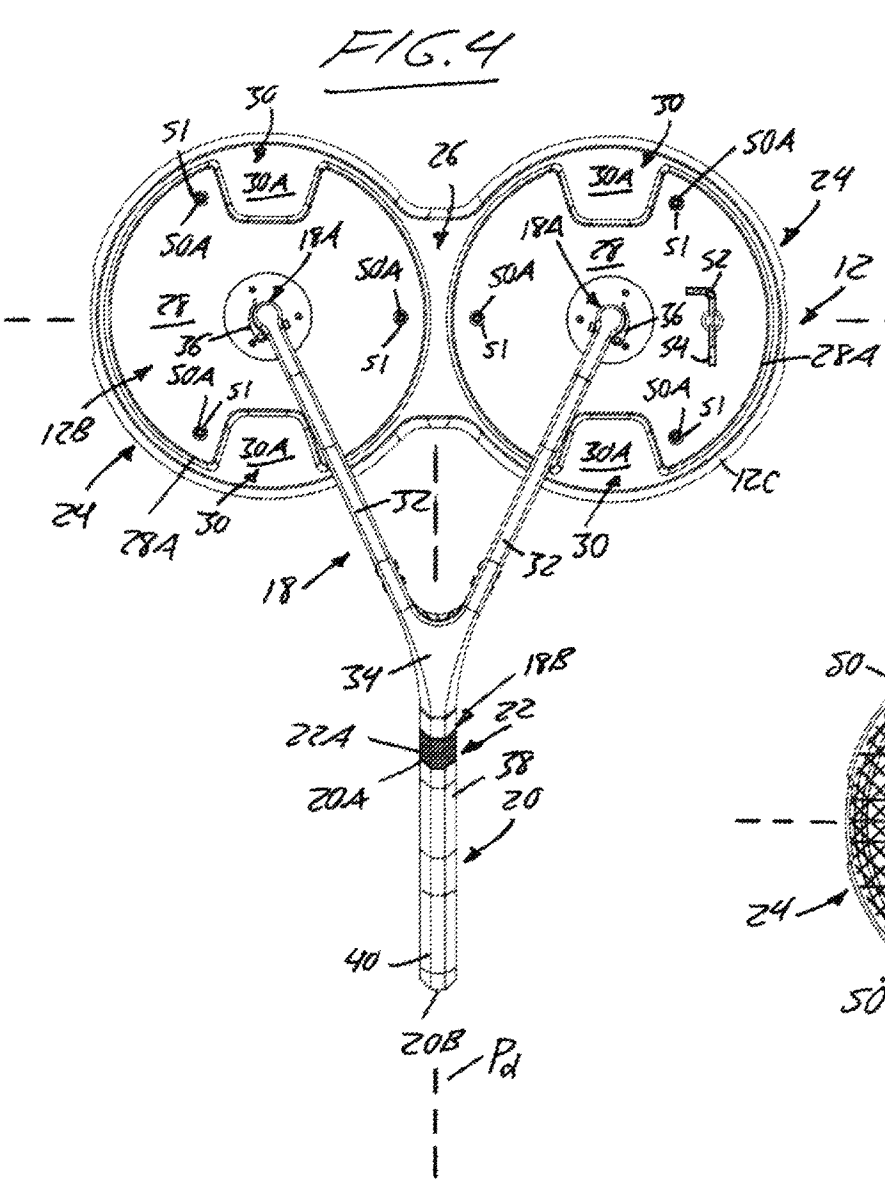
FIG. 4 is a top plan view of the hockey faceoff training device.

The hockey faceoff training device 10 of the preferred embodiment shown in the drawings features a base 12 for placement in a horizontally seated position atop a playing surface 100, a support structure 14 featuring two rigid support posts 16 standing vertically upright from the base 12, a Y-shaped connector 18 connected to the rigid support posts 16 at top ends thereof furthest from the base 12, and an impact member 20 having a proximal end 20A movably coupled to the connector 18 by a movable joint 22 that allows an opposing distal end 20B of the impact member to movable, at least upwardly and downwardly, relative to the playing surface 100 atop which the base is seated.

The base 12 has a planar underside 12A that faces toward and lies in parallel relationship to the playing surface 100, whether this playing surface is a sheet of hockey ice, an indoor floor or an outdoor ground surface at which an athlete wishes to perform faceoff training with the device. A topside 12B of the base 12 resides oppositely of the planar underside, and thus faces upwardly away from the underlying playing surface 100 on which the base is seated. An outer periphery 12C of the base 12 is 8-shaped in plan view, whereby the overall shape of the base in plan view is composed of two circular lobes 24 interconnected by a central neck 26. The central neck 26 joins together the two lobes 24 and is of reduced width relative to the diameter possessed by the two equally-sized lobes 24. Each of the two rigid support posts 16 stands vertically upright from the topside 12B of the base at a center point of a respective one of the circular lobes 24. At each lobe 24, the topside 12B of the base features a planar resting surface 28 residing in an uppermost plane of the base that lies normal to the upright axes of the two rigid support posts 16.

For the most part, an outer perimeter 28A of the resting surface 28 of each lobe 24 follows a concentric circular path around the respective support post 16 at a uniform radial distance outward therefrom. However, in the illustrated embodiment, the outer perimeter 28A of the resting surface 28 deviates from this circular path at two diametrically opposite locations, where the resting surface's outer perimeter 28A is recessed radially inward form the remaining circular majority of this outer perimeter. This creates a pair of access cavities 30 that reside oppositely of one another across the center point of the respective lobe 24 of the base. At each access cavity 30, the topside 12B of the base is recessed vertically downward from the resting surface 28, thereby creating a cavity floor 30A that of lesser elevation than the resting surface 28. The purpose of these access cavities 30 is explained herein further below.

The connector 18 has two angularly separated arms 32 joined together at a stem 34 of the connector's Y-shape. The two arms 32 are of convergent relation to one another in a direction moving toward said stem 34, and divergent relation to one another in the opposing direction moving away from said stem 34 toward the support posts 16. The connector thus possesses a greatest width at a mounting end 18A thereof at which free ends of the two arms 32 are removably mounted atop the two support posts 16, and a smallest width at the stem 34 that defines an opposing support end 18B of the connector where the two arms 32 are joined together at the to cooperatively support the impact member 20 via the movable joint 22.

For supporting the connector 18 atop the support posts 16, the free ends of the two arms 32 at the mounting end 18A of the connector feature hollow mounting bores that open upwardly into the arms from the undersides thereof, and that have a sufficient diameter to accommodate receipt of the top ends of the support posts 16 within these mounting bores. These mounting bores at the free ends of the arms thus define attachment points by which the connector is removably attachable to the support posts 16. In the illustrated embodiment, a lowermost portion of a boundary wall that delimits each mounting bore is of reduced thickness relative to a thicker upper portion of the boundary wall that surrounds the uppermost tip of the respective support post. This lowermost portion of the boundary wall is also axially split at one or more locations around the wall, whereby the reduced thickness and axially split character of the lowermost portion of the boundary wall cooperatively impart a flexibility thereto by which this lowermost portion can be selectively constricted and relaxed to clamp and release the arm 32 of the connector 18 to and from the respective support post 16. A respective securement clamp 36 is fitted around this lowermost boundary wall portion of each arm 32 of the connector 18, and is manually actuable between a tightened clamping state constricting the lowermost boundary wall portion, and a loosened release state relaxing the lowermost boundary wall portion.

Actuation of the securement clamp 36 into the tightened clamping state when the top end of the respective support post 16 is received in the hollow mounting bore of the arm 32 thus frictionally clamps the lowermost boundary wall portion tight against the support post. This helps prevent inadvertent separation of the removable connector 18 from the support posts 16 during use of the training device 10. In the illustrated embodiment, each securement clamp 36 is a quick-release skewer clamp of the type commonly used on removable bicycle wheels and bicycle seats, which is manually operable in tool-free fashion to enable quick assembly and disassembly of the training device 10. When the connector 18 is mounted and clamped to the support posts 16, the installed position of the connector 18 reaches outward from the shared vertical plane of the two support posts 16 to a front side of the device 10. This places the support end 18B of the connector outwardly past the periphery of the base 12 in this forward direction to a location overlying the playing surface 100. Here, the support end 18B of the connector resides at an elevation that is spaced above the playing surface 100, and that exceeds the elevation of the topside 12B of the base 12. As shown, the elevation of the support end 18B of the connector 18 may optionally be slightly lower than the top ends of the support posts 16, and thus also slightly lower than the mounting end 18A of the connector that is mounted atop the support posts.

The impact member 20 is of elongated shape whose length, as measured between the proximal and distal ends 20A, 20B thereof, notably exceeds its width and thickness, which are more comparably equal to one another. A proximal portion 38 of the impact member 20 that embodies the proximal end 20A thereof spans a respective linear distance from the movable joint 22, and thereby denotes a first fractional portion of the impact member's overall length. A distal portion 40 of the impact member 40 that embodies the distal end 20B thereof is integrally connected to the proximal portion 38, and spans a linear distance therefrom that denotes a second, and optionally shorter, remaining fractional portion of the impact member's overall length. The respective linear axes $A_p$, $A_d$ of the proximal and distal portions reside at a small acute angle to one another, whereby they collectively resemble to the angularly distinct shaft and blade sections of the lower part of a hockey stick. In a normal default position of the impact member, the proximal portion 38 thereof extends downward from the movable joint 22 toward the playing surface 100 at a relatively steep oblique angle thereto, and stops short of the playing surface 100. The distal portion 40 continues downward from the proximal portion 38 toward the playing surface, but at a more subtle (i.e. less steep) oblique angle thereto.

Figure 9A:
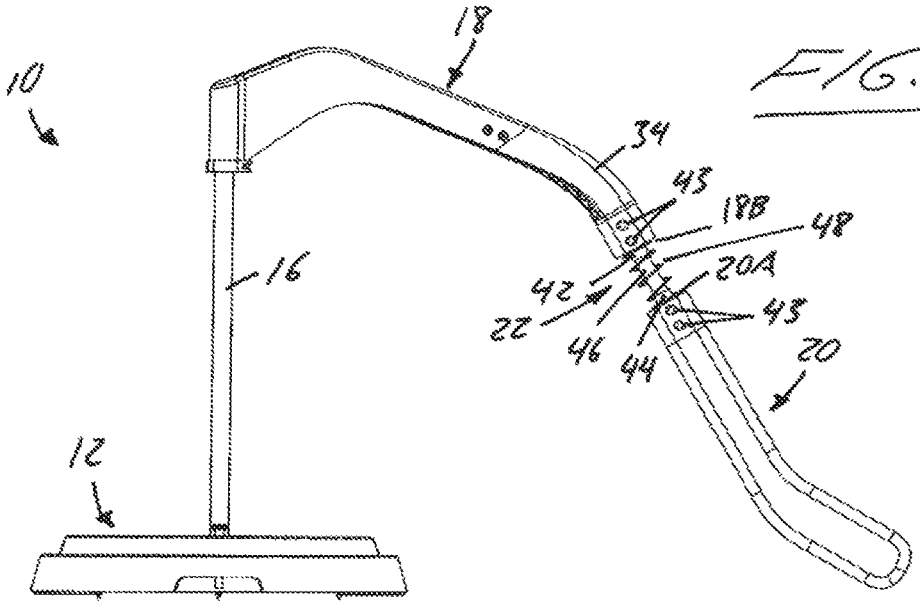
FIG. 9A is a side elevational view of the hockey faceoff training device with a joint-concealing cover thereof removed to illustrate internal components of a spring-loaded joint by which the impact member is movably supported.
Figure 9B:
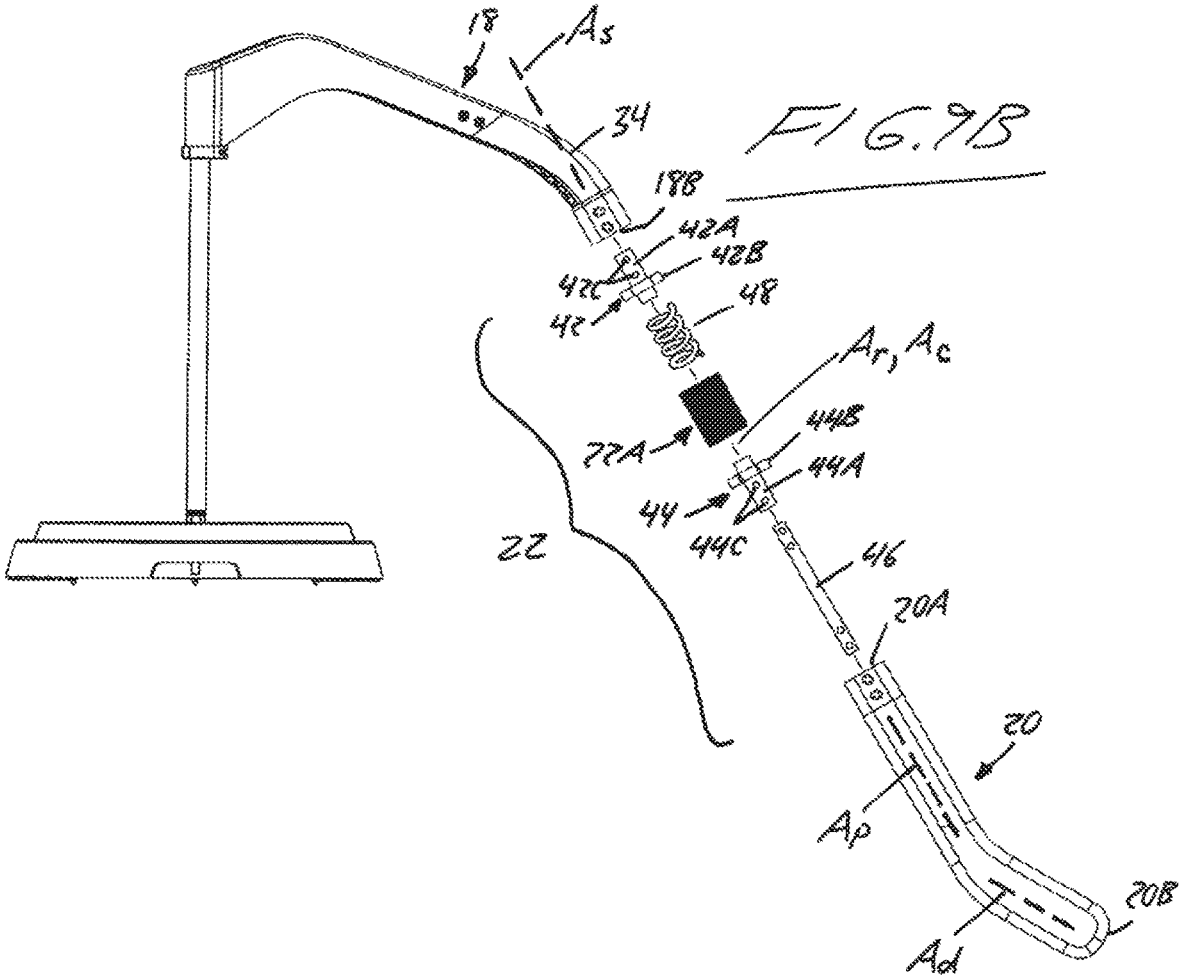
FIG. 9B is a partially exploded side elevational view of the hockey faceoff training device better revealing the internal joint components of FIG. 9A.

With reference to FIGS. 9A and 9B, the movable joint in the illustrated embodiment is a multi-piece assembly comprising an top end fitting 42 coupled to the support end 18B of the Y-shaped connector 18, a bottom end fitting 44 coupled to the proximal end 20A of the impact member 20, a resilient rod 46 formed or rubber or other resiliently flexible material, and a coil spring 48. Each end fitting 42, 44 is made of metal, rigid plastic or other non-flexible material, and features a tubular body 42A, 44A having a cylindrical through-bore sized to accept axial insertion of the resilient rod 46 therethrough. Somewhere between the two ends of the tubular body, each end fitting 42, 44 has an enlarged stop flange 42B, 44B that projects from the tubular body and span circumferentially therearound. The stop flange 42B, 44B of each fitting 42, 44 serves to limit how far the end fitting is insertable into a hollow interior of the respective one of either the support end 18B of the Y-shaped connector 18 or the proximal end 20A of the impact member 20. An insertion portion of the tubular member 42A, 44A on one side of the stop flange has a pair of cross-bores 42C, 44C therein that, when the end fitting is in its installed position of maximum insertion into the respective one of either the Y-shaped connector 18 or the impact member 20, aligns with a matching pair of cross-bores therein.

In the fully inserted and fastened position of each fitting 42, 44, a protruding portion of the tubular member 42A, 44A on the other side of the stop flange remains outside the hollow end of the respective one of either the Y-shaped connector 18 or the impact member 20. The protruding portion of the tubular member 42A, 44A of each fitting 42, 44 is received within the hollow center of the coil spring 48 at a respective end thereof, and the end of the spring 48 is preferably secured, for example by welding, to the fitting's stop flange 42B, 44B. The resilient rod 46 has an axial length exceeding that of the coil spring 48, and long enough to span from the hollow interior of the insertion portion of one end fitting 42 to the hollow interior of the insertion portion of the other end fitting 44. Near each of its ends, the resilient rod 46 has a pair of diametric cross-bores therein that align with both the cross-bores in the insertion portion of the respective fitting, and the matching cross-bores in the respective one of either the Y-shaped support 18 or the impact member 20. Via the sets of aligned cross-bores 42, 44, the two end fittings and the two ends of the resilient rod are respectively fastenable to the Y-shaped support 18 and the impact member, for example using bolts 43 or pins passed through these aligned bores. Though the illustrated embodiment uses a pair of adjacent bores at each fastening location for improved fastening strength and/or failure redundancy purposes, a singular bore for accepting a singular fastener may alternatively suffice.

Referring to the assembled state of the movable joint 22 in FIG. 9A, the resilient rod 46 connects the Y-shaped support 18 and the impact member 20 together, and in doing so spans across a gap space between the two end fittings 42, 44. The flexibility of the rod 46 allows movement of the impact member 20 in multiple directions relative to the Y-shaped support 18. The coil spring 48 spiralling externally around the flexible rod 46, and round the protruding portions of the end fittings, can likewise flex in multiple directions, thus likewise permitting such multi-directional movement of the impact member relative to the Y-shaped support. The resiliently flexible nature of both the resilient rod 46 and the coil spring 48 serve to automatically return the impact member to a normal default position.

An early prototype using a compression spring was found to impart less stiffness to the movable joint 22 than a later prototype using a tension spring, whose greater stiffness provided greater user-resistance to movement of the impact member, and faster return of the impact member to the normal default position. Though the tension spring was preferred, both options are possible, and selection of the spring type (compression vs. tension), spring coil quantity, and/or other parameters of the spring may be left to a matter of preference. The combination of both the spring and the resilient rubber rod is preferred, where the inclusion of the resilient rod is believed to help with impact absorption and vibration damping vs. use of the spring alone, while the coil spring is believed to impart a faster more reliable snapping of the of the impact member 20 back into a properly centered default position vs. use of the resilient rod 46 alone. That being said, alternate embodiments may include spring-only joints lacking a resilient internal rod running axially through the spring, and rod-only joints lacking a coil spring spiraling externally around the resilient rod.

Figure 7:
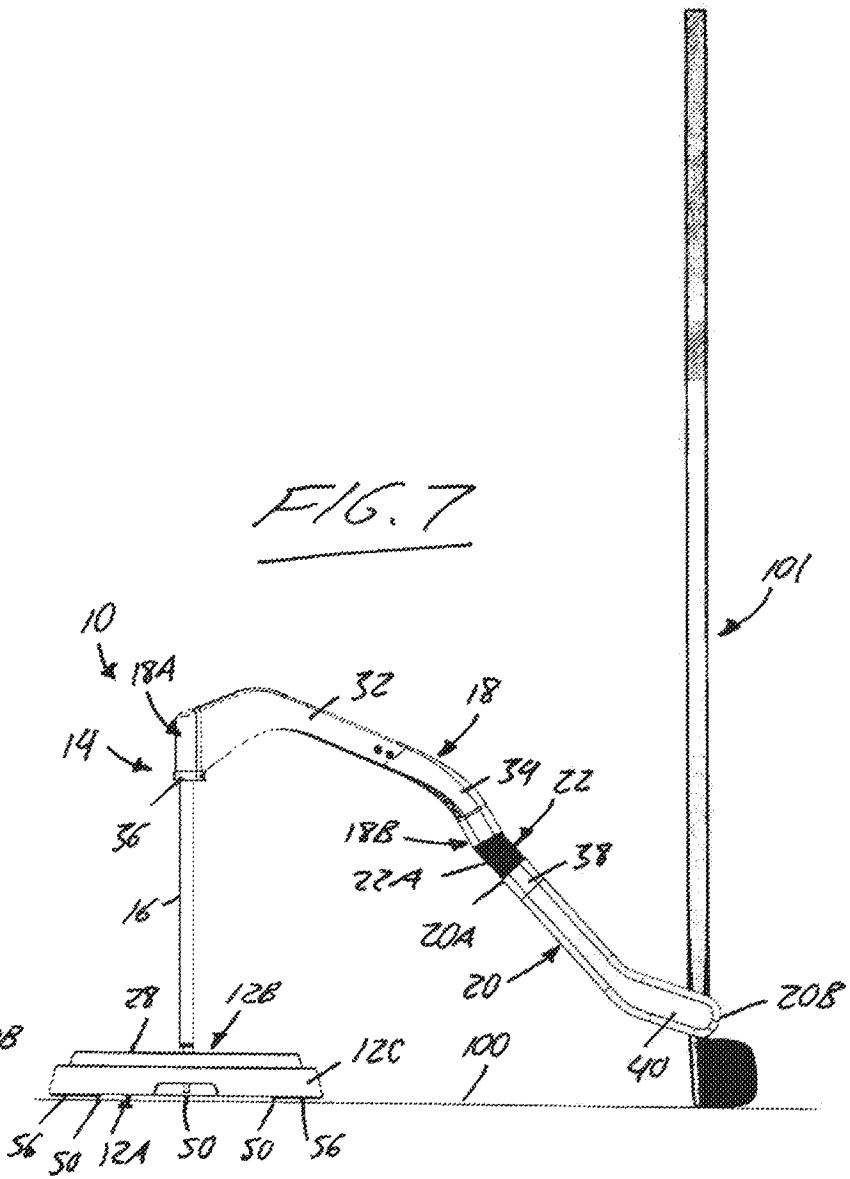
FIG. 7 is another side elevational view of the hockey faceoff training device, but showing the impact member pivoted upward from the default position under impact by the hockey stick.
Figure 6:
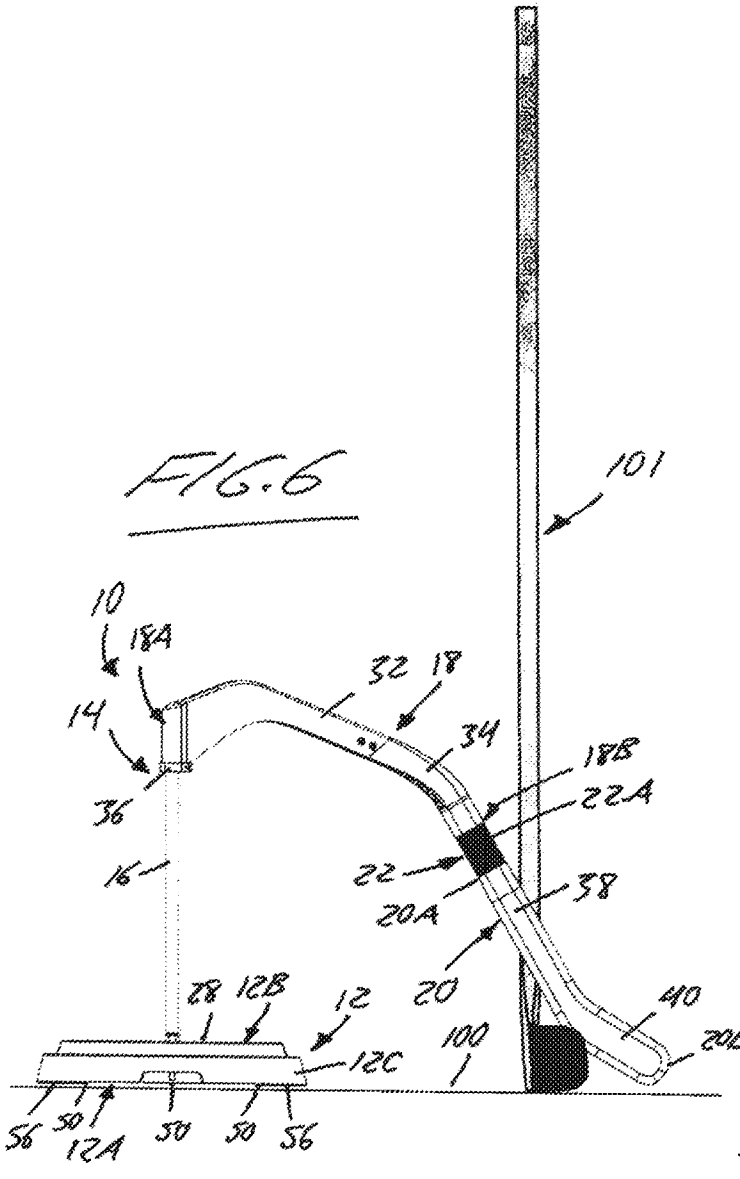
FIG. 6 is a side elevational view of the hockey faceoff training device with an impact member thereof spring biased into a default position ready for impact by a practicing athlete's hockey stick.

Via the movable joint 22, the forwardly and downwardly angled impact member 20 can swing upwardly and downwardly relative to the playing surface 100, thus allowing a training athlete to use the blade of their hockey stick 101 to lift the distal end 20B of the impact member 20 from a normal default position that touches, or is at least closely adjacent to, the playing surface 100. Such movement of the impact member's distal end 20B between the normal default position and a lifted position can be seen through comparison of FIG. 6 (normal default position) and FIG. 7 (lifted position). On top of gravitational resistance to such stick-performed lifting of the impact member 20, the movable joint 22 of the illustrated embodiment adds additional resistance through inclusion of the resilient rod 46 and coil spring 48. For safety purposes, or other motivated reason to conceal the moving internal parts of the movable joint 22, a flexible cover 22A, for example in the form of an accordion pleated sleeve, may be used as shown to circumferentially encompass the spring 48, the rod 46 and the fittings 42, 44, and may span a full axial length of the joint from the proximal end 20A of the impact member 20 to the support end 18B of the connector 18.

Figure 8:
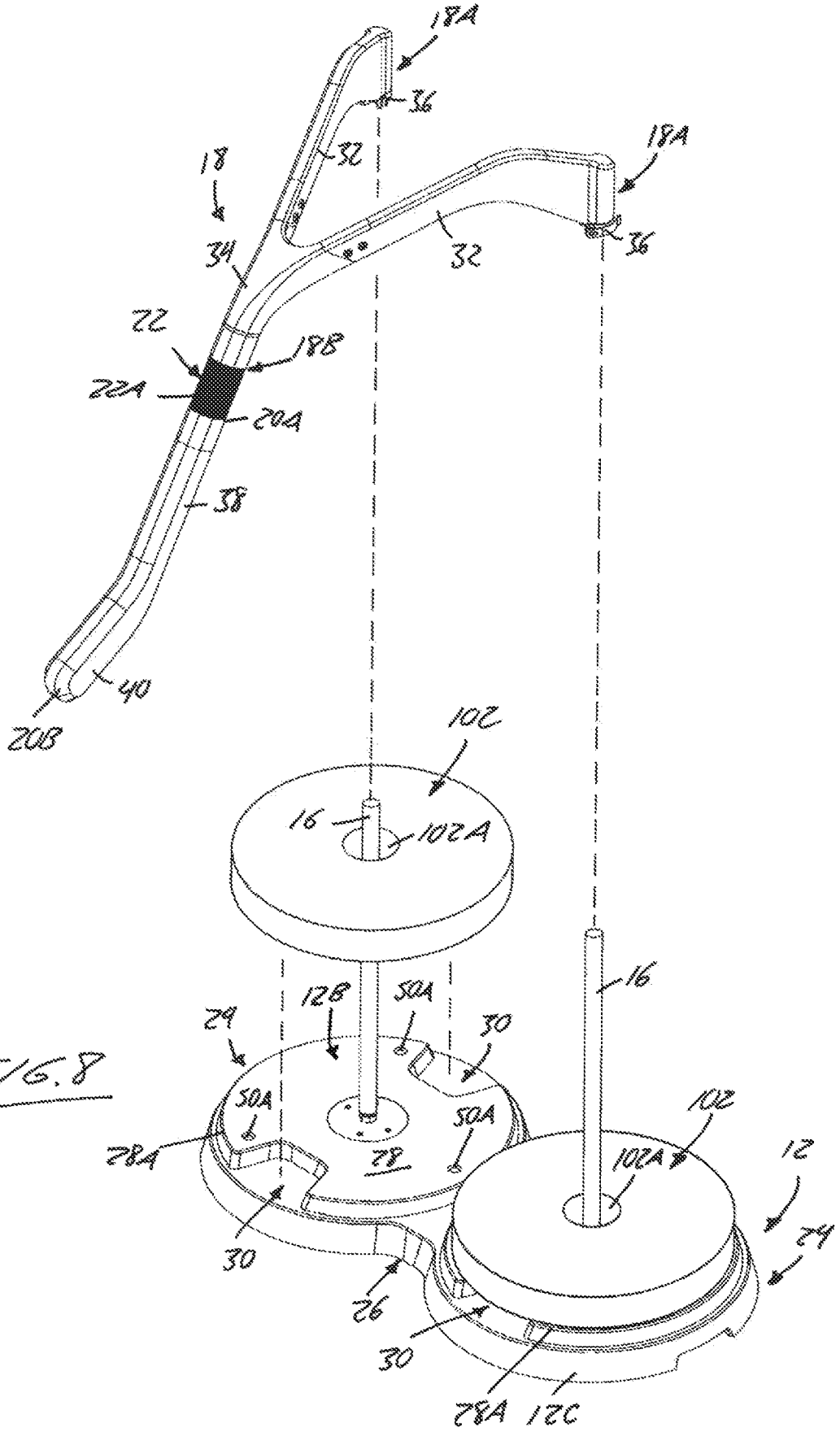
FIG. 8 is a partially exploded view of the hockey faceoff training device, illustrating stacked placement of disc weights atop a base thereof to weigh down base and help hold the training device stationary during use.

In the normal default position of the impact member 20, the rod 46 and coil spring 48 are in default linear states in which their coincident central axes $A_r$, $A_c$ are linear, and reside coincidently parallel with the proximal axis of the impact member and with a matching stem axis $A_s$ of the connector's stem, all within a default vertical plane $P_d$ normally occupied by the axes of the impact member 20. This default vertical plane bisects the Y-shape of the connector 18, and is oriented normal to a vertical reference plane $P_r$ that contains the two support posts 16. The rod 46 and spring 48 thus reside in-line with both the stem 34 of the connector 18 and the proximal portion 38 of the impact member when the impact member is in the normal default position and the rod and spring are in their corresponding default linear states. Lifting of the impact member 20 by the athlete's hockey stick flexes the rod 46 and coil spring 48 out of their default linear states, thus providing resistance to such movement of the impact member. On removal of the hockey stick's lifting force, the natural tendencies of the rod 46 and spring 48 to return to their default linear states will bias the impact member 20 back into its corresponding default position, placing the distal end 20B thereof into contact, or close adjacency, to the playing surface 100. Likewise, knocking of the impact member sideways by the athlete's hockey stick acts to swing the impact member laterally out of its default vertical plane, thus again flexing the rod 46 and coil spring 48 out of their default linear states and thereby causing resistance to such movement, until the lateral hockey stick force is removed, whereupon the natural return tendencies of the rod and spring again bias the impact member back into its default vertical plane. Any stick action tending to angularly rotate the impact member about its proximal axis will impart a twisting action on the rod 46 and coil spring 48, again creating resistance to such movement, and the natural tendencies of the rod and spring to the return to their default untwisted states will subsequently return the impact member to is normal angular orientation about its proximal axis once the rotation-imparting stick force is removed. FIG. 8 illustrates use of disc weights 102 placed on the resting surfaces 28 of the base in order to stabilize the base in a stationary position by weighing it down against the support surface 100. To enable placement and removal of disc weights 102 onto and from the topside of the base, the securement clamps 36 are released and the connector 18 is lifted off the support posts 16. The disc weights 102 are stackable on the base 12 by sliding a central axial opening 102A of each disc weight over one of the support posts 16. Each support post 16 is of slightly lesser diameter than the axial opening 102A in each of the disc weights 102. A respective stack of weights 102 can be placed over each support post 16, and a bottom face of the lowermost disc weight 102 in each stack rests on the resting surface 28 of the respective lobe 24 of the base 12, and covers a full or substantially full area of this resting surface 28. Below the resting surface 28, the access cavities 30 remain unoccupied by any disc weight that is being placed, or is already sitting, on the resting surface 28. Therefore, the fingers of a user's hand being used to grip the outer edge of the disc weight 102 at a respective side thereof can be accommodated in each access cavity 30 during both placement and removal of disc weights 102 onto and from the base 12. The disc weights 102 increase the overall effective weight of the base 12 to help retain a stationary state thereof on playing surface 100 during use of the device 10.

Once one or more disc weights 102 have been stacked atop the base 12, the connector 18 is placed atop the support posts 16 and secured thereto by tightening of the securement clamps 36. The support ports 16 are preferably removable from the base 12 for optimal collapse the size of the device for compact storage or transport when not in use. For such purpose, the bottom ends of the support posts 16 may be externally threaded for mating with an internally threaded coupler provided on the base at the center point of each lobe 24. This way, the base 12, support posts 16, and connector 18 may all be disassembled from one another to allow optimally compact storage or transport of the device 10, for example with the removed support posts 16 and removed connector 18 laid down alongside or atop the base 12.

The illustrated embodiment of the present invention makes use of the same support posts 16 both to keep the stacked disc weights 102 in place atop the base 12, and to form part of the support structure 14 by which the proximal end 20A of the impact member 20 is movably supported at a spaced elevation above the base and playing surface. This denotes one improvement over Applicant's prior U.S. and Canadian patents cited above. The novel design of the movable joint also represents a more elegant solution that the hinge-joint and spring setup shown in the illustrated embodiment of Applicant's said prior patents. While the illustrated embodiment features two support posts 16, a base sufficiently sized to accommodate two respective stacks of disc weights 102, and a Y-shaped connector 18 suitably shaped to mount atop both support posts 16 such that swivelling of the connector 18 about the upright axis of either support post is prevented, other embodiments could employ only a singular support post 16 and a differently shaped connector 18, provided that a suitable means for preventing swivel of the connector relative to the singular support post is included in such variants.

To better hold the base 12 stationary on at least some types of playing surface 100, a set of selectively deployable/retractable grip spikes 50 are provided on the base. Each grip spike 50 is movable into and out of a deployed position protruding downwardly from the underside 12A of the base 12 (as shown in the drawings) so that bottom tips of the spikes 50 engage into the playing surface 100. In a retracted position, the spike 50 does not protrude beyond the underside 12A. This way, the user can select whether or not to deploy the grip spikes 50 depending on whether the playing surface is of a type penetrable by such spikes, and if so, whether the playing surface is one that is irrevocably damaged by such penetration of the playing surface.

In the illustrated example, each spike 50 is individually actuated for movement between its two positions, though other embodiments may alternatively employ a shared deployment/retraction mechanism. Each spike 50 comprises an externally threaded body received in a correspondingly threaded through-bore 51 of the base 12, whereby rotation of the spike 50 in opposing directions within said threaded bore 51 axially displaces the spike in opposing upward and downward directions. Each spike has a driving head 50A at the top end of its threaded body, and a tool-engageable female feature in the top of the driving head 50A. Using this female feature, the driving head 50A is engageable by a the male working tip of a suitable driving tool 52 through the open top end of the threaded bore at the topside of the base, thus enabling tool driven rotation of the spike to actuate the linear displacement thereof between the deployed and retracted positions. In the illustrated example, the tool-engageable female feature in the driving head of each spike is a hexagonal cavity, and the driving tool 52 is an L-shaped hex key, though other feature shapes and tool types may alternatively be employed. While typically one would use a male-tipped tool to drive a female feature on the spike head, a female tipped tool (socket) may alternatively be used to engage externally over a suitably shaped head of the spike.

In the illustrated embodiment, each lobe of the base 12 features three spikes 50 disposed in three respective through-bores that penetrate the seating surface 28 at a same radial distance outward from the respective support post 16 at uniformly spaced positions therearound. Positioned in the seating surfaces 28 that are occupied by the disc weights 102 when stacked atop the base 12, the spike-containing through-bores 51, and thus the driving heads 50A of the spikes 50 contained therein, are covered by the disc weights 102 when stacked atop the base. Likewise, a tool cavity 54 that is recessed downwardly into the seating surface 28 of one of the lobes 24 of the base 12 for storage of the driving tool 52 therein is situated at a location that is covered by one of the disc weights 102 when stacked atop the base. Accordingly, the user cannot access the spikes 50 or the driving tool 52 in order to change the positions off the spikes, unless the weights 102 have been removed. This way, the user must remove the disc weights before the spikes can be retracted, thus encouraging the user to remove the weights before attempting to move the device from the playing surface to a storage location or into a transport vehicle, presuming that the user does want to incur spike-induced surface damage to said storage location or transport vehicle. To provide some frictional resistance to sliding of the base 12 along the playing surface even when the spikes 50 are not deployed, the underside 12A of the base 12 preferably includes frictional pads or feet 56, for example formed of a resilient rubber material. When such frictional pads or feet 56 are included, the deployed positions of the grip spikes protrude beyond the lowermost plane of these pads or feet to ensure engagement with the playing surface.

PARTS LEGEND training device 10
base 12
underside 12A
topside 12B
outer periphery 12C
support structure 14
rigid support posts 16
Y-shaped connector 18
impact member 20
proximal end 20A
distal end 20B
movable joint 22
circular lobes 24
central neck 26
resting surface 28
access cavity 30
cavity floor 30A
connector arms 32
connector stem/vertex 34
securement clamp 36
impact member proximal portion 38
impact member distal portion 40
end fittings 42, 44
bolts 43
resilient rod 46
coil spring 48
spikes 50
tool 52
tool cavity 54
pads/feet 56
playing surface 100
hockey stick 101
disc weights 102
disc weight opening 102A Since various modifications can be made in my invention as herein above described, and many apparently widely different embodiments of same made, it is intended that all matter contained in the accompanying specification shall be interpreted as illustrative only and not in a limiting sense.

The invention claimed is:

1. A hockey faceoff training device comprising:

a singular base for placement in a seated position atop an underlying playing surface, said base having an underside that faces said playing surface in said seated position and an opposing topside that faces upwardly away from said playing surface in said seated position;

a pair support posts both attached or attachable to said singular base in spaced apart positions standing upright therefrom at locations spaced inwardly from an outer perimeter of the singular base such that each support post is surrounded on all sides thereof by a respective resting surface of the base, at which a respective stack of disc weights are stackable over said support post onto said respective resting surface in order to weigh down said base in the seated position atop the underlying playing surface;

a connector having two attachment points that are respectively attachable to said support posts at elevated locations thereon above the stacks of weights after stacking thereof over the support posts onto the respective resting surfaces, such that in an installed position of the connector at said elevated locations on the support posts, said connector resides in overhead relation to said stacks of disc weights; and an impact member coupled to said connector at a location thereon between said two attachment points, is coupled to said connector via a moveable joint, and has a proximal end adjacent said connector and an opposing distal end opposite said connector;

wherein said impact member is biased into a default position extending downwardly from the connector and placing the distal end of the impact member in contact or adjacency to the playing surface, and the impact member, by way of the movable joint, is movable in one or more directions lifting said distal end of the impact member upwardly away from said playing surface.

2. The device of claim 1 wherein the connector has a non-uniform width that narrows away from said two attachment points toward the movable joint.

3. The device of claim 1 wherein said connector comprises a pair of angularly separated arms of obliquely angled relation to one another that respectively define said two attachment points, and that obliquely converge away therefrom toward the movable joint.

4. A hockey faceoff training device comprising:

a base for placement in a seated position atop an underlying playing surface, said base having an underside that faces said playing surface in said seated position and an opposing topside that faces upwardly away from said playing surface in said seated position;

two support posts attached or attachable to said base in a position standing upright therefrom over which disc weights are lowerable into stacked condition atop the base to weigh down said base in the seated position atop the underlying playing surface;

a connector removably attached or attachable to said one or more support posts at top ends thereof; and an impact member coupled to said connector via a moveable joint, said impact member having a proximal end adjacent said connector and an opposing distal end opposite said connector;

wherein:

said impact member is biased into a default position extending downwardly from the connector and placing the distal end of the impact member in contact or adjacency to the playing surface, and the impact member, by way of the movable joint, is movable in one or more directions lifting said distal end of the impact member upwardly away from said playing surface;

wherein the two support posts allow for stacking of said disc weights in two respective stacks atop said base, and the connector comprises two attachment points for respective removable attachment to the top ends of the two support posts; and said connector is a Y-shaped connector having a stem to which the impact member is connected by said movable point in a manner placing the proximal end of said impact member in-line with said stem of the Y- shaped connector in the default position of said impact member.

5. The device of claim 1 wherein an outer perimeter of said base is 8-shaped in plan view, whereby the base has two circular lobes, each of which has a center point at which a respective one of the two support posts is attached or attachable.

6. The device of claim 1 wherein said movable joint comprises a coil spring and/or resiliently flexible rod that, in the default position of the impact member, reside in an unflexed default linear state spanning along a linear axis in an in-line relationship with the proximal end of the impact member.

7. The device of claim 1 comprising a flexible cover enclosing said movable joint between the impact member and the connector.

8. The device of claim 6 comprising a flexible cover encompassing said coil spring and/or resiliently flexible rod between the impact member and the connector.

9. The device of claim 1 further comprising deployable and retractable grip spikes movable between deployed positions of downwardly protruding relation to the underside of the base, and retracted positions of non-protruding relation to the underside of the base.

10. The device of claim 9 wherein movement of the grip spikes between said deployed and retracted positions is controlled from the topside of the base.

11. The device of claim 10 wherein movement of the grip spikes between said deployed and retracted positions is controlled from the topside of the base at one or more locations thereon that are concealed under the disc weights when stacked atop the base.

12. The device of claim 9 comprising a driving tool for actuating movement of the grip spikes between said deployed and retracted positions, wherein the base comprises a recessed tool cavity in the topside thereof for storage of said driving tool at a position concealed under the disc weights when stacked atop the base.

13. The device of claim 1 wherein the topside of the base, at one or more locations situated around each support post, comprises one or more recessed access cavities, each of greater width than said support post, to accommodate multiple fingers of a user, in positions of gripped relation around an outer edge of one of the disc weights, during placement or removal of said one of the disc weights onto or from said base.

14. A hockey faceoff training device comprising:

a support structure positioned or positionable in a position standing upright from a playing surface;

an impact member having a proximal end supported, or arranged for support, on the support structure by a moveable joint at an elevated distance above said playing surface;

wherein:

said impact member is biased into a default position extending downwardly from the connector and placing the distal end of the impact member in contact or adjacency to the playing surface;

the impact member, by way of the movable joint, is movable in one or more directions lifting said distal end of the impact member upwardly away from said playing surface;

said movable joint comprises at least one of either a coil spring and/or a resiliently flexible rod that, in the default position of the impact member, resides in an unflexed default linear state spanning along an obliquely inclined linear axis in an in-line relationship with the proximal end of the impact member; and said at least one of either said coil spring and/or said resiliently flexible rod defines a sole constraint of said movable joint on allowable movement of the impact member, and when temporarily flexed out of the unflexed linear state by impact of the impact member with a hockey stick, subsequently returns to the unflexed default linear state, thereby returning the impact member to the default position.

15. A hockey faceoff training device comprising:

a base for placement in a seated position atop an underlying playing surface, said base having an underside that faces said playing surface in said seated position and an opposing topside that faces upwardly away from said playing surface in said seated position;

one or more support posts attached or attachable to said base in a position standing upright therefrom over which disc weights are lowerable into stacked condition atop the base to weigh down said base in the seated position atop the underlying playing surface;

an impact member having a proximal end supported, or arranged for support, by a moveable joint at an elevated distance above said base and an opposing distal end opposite said proximal end;

wherein:

said impact member is biased into a default position extending downwardly from the connector and placing the distal end of the impact member in contact or adjacency to the playing surface;

the impact member, by way of the movable joint, is movable in one or more directions lifting said distal end of the impact member upwardly away from said playing surface; and the topside of the base, at one or more locations situated around each support post, comprises one or more recessed access cavities, each of greater width than said support post to accommodate multiple fingers of a user, in positions of gripped relation around an outer edge of one of the disc weights, during placement or removal of said one of the disc weights onto or from said base.

16. The device of claim 14 wherein the unflexed default linear state of said at least one of either said coil spring and/or said resiliently flexible rod also has an in-line relationship with an obliquely downward pointing support location on the support structure that is intersected by said obliquely inclined linear axis, (ii) is oriented to point obliquely downward toward the playing surface, and is where the movable joint attaches to the support structure.

17. The device of claim 16 wherein the support structure comprises two upright supports, and a Y-shaped connector having two divergent arms respectively attached to said upright supports and a stem whose terminal end defines said support location at which said at least one of either said coil spring and/or said resiliently flexible rod is connected and, when unflexed, resides in-line with said stem.

18. The device of claim 14 wherein said at least one of either said coil spring and/or said resiliently flexible rod comprises both thereof, of which said coil spring coils around said resiliently flexible rod.

19. The device of claim 6 wherein said movable joint comprises both said coil spring and said resiliently flexible rod, of which said coil spring is coiled around said resiliently flexible rod.

* * * * *